US012194363B2

(12) United States Patent
Galloway et al.

(10) Patent No.: US 12,194,363 B2
(45) Date of Patent: Jan. 14, 2025

(54) SMART PUTTER FOR AUTOMATIC PUTTER GAME SCORING

(71) Applicant: Kilburn Live, LLC, Los Angeles, CA (US)

(72) Inventors: Vance William Galloway, Seattle, WA (US); Marcellino Tanumihardja, Los Angeles, CA (US); Bart Van Den Berg, Pijnacker (NL)

(73) Assignee: Kilburn Live, LLC, Los Angeles, CA (US)

( * ) Notice: Subject to any disclaimer, the term of this patent is extended or adjusted under 35 U.S.C. 154(b) by 215 days.

(21) Appl. No.: 17/820,826

(22) Filed: Aug. 18, 2022

(65) Prior Publication Data

US 2023/0233922 A1 Jul. 27, 2023

Related U.S. Application Data

(60) Provisional application No. 63/267,024, filed on Jan. 21, 2022.

(51) Int. Cl.
*A63B 69/36* (2006.01)
*A63B 53/00* (2015.01)
(Continued)

(52) U.S. Cl.
CPC ..... *A63B 71/0605* (2013.01); *A63B 60/46* (2015.10); *A63B 53/007* (2013.01);
(Continued)

(58) Field of Classification Search
CPC ... A63B 71/0605; A63B 60/46; A63B 53/007; A63B 67/02; A63B 2220/40;
(Continued)

(56) References Cited

U.S. PATENT DOCUMENTS 7,789,742 B1 * 9/2010 Murdock ..... G16H 40/67 463/2
8,202,148 B2 6/2012 Young
(Continued)

FOREIGN PATENT DOCUMENTS

CN 110270077 A 9/2019
EP 2600946 B1 2/2019
(Continued)

OTHER PUBLICATIONS

PCT Notification of Transmittal of the International Search Report and the Written Opinion of the International Searching Authority for International Application No. PCT/US2023/061097; dated Jun. 2, 2023.

(Continued)

*Primary Examiner* — Nini F Legesse
(74) *Attorney, Agent, or Firm* — Patterson + Sheridan, LLP; Todd Patterson; Orson Bell

(57) ABSTRACT

Certain aspects of the present disclosure provide techniques for a smart putter and a putter gaming system. The smart putter may be configured with a plurality of sensors. The smart putter may be configured to process information from the plurality of sensors to determine whether a stroke has been performed by a user of the smart putter. Detecting a stroke has occurred may include detecting that the smart putter has impacted a golf ball on a field of play. The smart putter may further be configured to sign-in with a track associated with the putter gaming system. The putter gaming system may be configured to perform automatic scoring based, in part, on the stroke detection performed by the smart putter. The putter gaming system may further be configured to detected when a golf ball has been holed, indicating completion of a track.

18 Claims, 6 Drawing Sheets

(51) Int. Cl.
*A63B 60/46* (2015.01)
*A63B 71/06* (2006.01)
*A63B 67/02* (2006.01)

(52) U.S. Cl.
CPC ..... *A63B 67/02* (2013.01); *A63B 2220/40* (2013.01); *A63B 2220/801* (2013.01); *A63B 2220/808* (2013.01); *A63B 2220/833* (2013.01); *A63B 2225/54* (2013.01)

(58) Field of Classification Search
CPC ..... A63B 2220/801; A63B 2220/808; A63B 2220/833; A63B 2225/54; A63B 2024/0068; A63B 24/0062; A63B 53/0487; A63B 53/10; A63B 2024/0028; A63B 2209/08; A63B 71/0622; A63B 2220/12; A63B 2220/16; A63B 2220/17; A63B 2220/30; A63B 2220/34; A63B 2220/44; A63B 2220/53; A63B 2220/803; A63B 2220/89; A63B 2225/20; A63B 2225/50; A63B 2225/74
USPC ..... 473/150–155, 192, 169, 221, 222, 223, 473/233, 176, 353
See application file for complete search history.

(56) References Cited

U.S. PATENT DOCUMENTS

| | | | | |
|---|---|---|---|---|
| 8,870,671 | B1 | 10/2014 | Foley | |
| 10,097,961 | B2 | 10/2018 | Nuesmeyer et al. | |
| 10,232,225 | B1 * | 3/2019 | Oberc | A63B 69/3655 |
| 10,688,366 | B1 * | 6/2020 | Petrich | A63B 37/0051 |
| 10,716,971 | B1 * | 7/2020 | Oberc | A63B 69/36 |
| 10,780,319 | B2 | 9/2020 | Davenport | |
| 11,786,794 | B1 * | 10/2023 | Raposo | A63B 37/0076 473/353 |
| 2014/0260635 | A1 * | 9/2014 | Leech | G09B 19/0038 73/645 |
| 2014/0266160 | A1 * | 9/2014 | Coza | A63B 47/008 324/207.11 |
| 2015/0238840 | A1 | 8/2015 | Jung et al. | |
| 2016/0317896 | A1 | 11/2016 | Albelo | |
| 2017/0007902 | A1 * | 1/2017 | Cottam | G16H 40/63 |
| 2017/0144021 | A1 * | 5/2017 | Glenn | A63B 60/46 |

FOREIGN PATENT DOCUMENTS

| | | | |
|---|---|---|---|
| EP | 2778708 | B1 | 11/2019 |
| KR | 20170105337 | A | 9/2017 |
| WO | 2009014103 | A1 | 1/2009 |
| WO | 2012144793 | A2 | 10/2012 |

OTHER PUBLICATIONS

Umek et al., "Suitability of Strain Gage Sensors for Integration into Smart Sport Equipment: A Golf Club Example", MDPI, Sensors, 2017, 17, 916; 18 pages.

R. Burchfield and S. Venkatesan, "A Framework for Golf Training Using Low-Cost Inertial Sensors," IEEE, 2010 Intl. Conference on Body Sensor Networks, 2010, pp. 267-272.

Western Michigan University, College of Engineering and Applied Sciences, "Electrical and Computer Engineering Department 2013-2014 Newsletter" (2014). Eletrical and Computer Engineering Newsletter.9; https://scholarworks.wmich.edu/electrical-computer_news/9.

Dong, et al., "Versatile Core-Sheath Yarn for Sustainable Biomechanical Energy Harvesting and Real-Time Human-Interactive Sensing", Advanced Energy Materials, Triboelectric Nanogenerators, 2018, 8, 1801114, 12 pages.

Canadian Examination Research Report dated Nov. 9, 2023, for CA Application No. 3,171,789.

* cited by examiner

SMART PUTTER FOR AUTOMATIC PUTTER GAME SCORING

CROSS-REFERENCE TO RELATED APPLICATION(S)

This application claims benefit of and priority to U.S. Provisional Application No. 63/267,024, filed Jan. 21, 2022, which is hereby assigned to the assignee hereof and hereby expressly incorporated by reference herein in its entirety as if fully set forth below and for all applicable purposes.

INTRODUCTION

Field of the Disclosure

Aspects of the present disclosure relate to smart golf clubs, and more particularly, to a smart golf putter for a miniature-golf games with automatic scoring.

Description of Related Art

Conventionally, miniature golf (mini-golf) and related putter games are manually scored by the players (or by an observer. By way of example, players may carry around a score card on which they self-score at each track. As used herein, a track refers to the green (e.g., the field of play) and one or more holes in the green. The player may count and record a number of strokes. As used herein a stroke may refer to an intentional swing of the golf club or putter making contact with a golf ball. Each track may be associated with a par, or a target number of strokes in which the player attempts to hit the golf ball into the track hole (or holes). The player's score can then be determined as the difference between the number of the player's strokes and the par. These manual scorecards may be inaccurate, easy to misplace, difficult for children or some players to use, and subject to discretionary scoring. In addition, manual scoring requires the player's input and time, which may detract from the player's game experience.

Some attempts to automate scoring have included mechanical stroke counters attached to a golf club, running cables to golf balls, and outfitting golf clubs with impact sensors to detect ball strokes. These methods may be inaccurate, for example, failing to differentiate between a true stroke (swinging and striking a golf ball) and other false detections, such as striking the ground, bumping a different object, or other impacts of the putter that are not actual strokes. Any such inaccuracies in stroke detection can lead to inaccurate score counting, detracting from the player's experience with the putter game.

Thus, techniques and apparatus for an improved smart putter that can perform strike detection that minimizes false detection and a putter game system, including a smart putter, for automatic score counting in putter games are desired.

SUMMARY

The systems, methods, and devices of the disclosure each have several aspects, no single one of which is solely responsible for its desirable attributes. Without limiting the scope of this disclosure as expressed by the claims that follow, some features will now be discussed briefly. After considering this discussion, and particularly after reading the section entitled "Detailed Description" one will understand how the features of this disclosure provide advantages that include a smart putter providing automatic scoring for putter games.

Certain embodiments provide a smart putter. In some embodiments, the smart putter is configured to sign-in with a putter game system. In some embodiments, the smart putter includes a radio frequency identifier (RFID) transmitter and the track includes an RFID reader that reads the RFID tag of the smart putter when the player holds the smart putter near a sign-in point at the track to sign-in the smart putter with the putter game system. In some embodiments, the smart putter detects a beacon from the putter game system and attempts to sign-in with the putter game system based on detecting the beacon. In some embodiments, after the smart putter signs-in with the putter game system, an indicator light is activated to signal to the user that the putter game is ready to begin.

In some embodiments, the smart putter is configured to perform stroke detection using a combination of sensors. In some embodiments, the combination of sensors includes at least an accelerometer and a magnetometer. In some embodiments, the accelerometer data is filtered and processed to provide a signal indicating an impact is detected between the smart putter and an object. In some embodiments, the magnetometer is configured to detect changes in a magnetic field between the smart putter and another object, where the system includes a magnetic golf ball, such that when the smart putter is within a threshold proximity of the magnetic golf ball, the smart putter provides a signal indicating the smart putter is within proximity of the magnetic golf ball. The combination of the signals from the accelerometer and the magnetometer may indicate, when the signals are detected within a threshold time duration of each other, that a stroke has occurred. As used herein, a stroke may be defined as when the putter comes into contact with a golf ball on the field of play. In some embodiments, the smart putter provides a stroke detection signal to a base station, where a stroke count of a user associated with the smart putter is tracked for the purposes of automatically scoring a putter game the user is playing.

In some embodiments, the smart putter uses additional or alternative sensors for stroke detection.

In some embodiments, a hole located at a track associated with the putter game system is configured with a sensor to detect when a golf ball has been "holed", indicating a player's completion of the track. In some embodiments, when the sensor detects a golf ball has been "holed", a transmitter at the hole sends a signal to the base station indicating that the player has completed the track. Based on receiving the signal from the hole indicating the player has completed the track, the base station may compute a score for the player further based on the tallied strokes for the player. In some embodiments, the player's score is displayed to the player on a display.

Certain embodiments provide a smart golf club. The smart golf club includes a shaft; a club head coupled to an end of the shaft; a magnetometer configured to collect magnetic field data associated with the smart golf club; an accelerometer configured to collect acceleration data associated with the smart golf club; a microcontroller configured to detect, based on the magnetic field data and the acceleration data, that a contact of the smart golf club with a golf ball has occurred; and a power supply configured to supply power to one or more of: the magnetometer, the accelerometer, and the microcontroller.

Certain embodiments provide a method for stroke detection. The method for stroke detection includes collecting magnetic field data associated with a smart golf club; collecting acceleration data associated with the smart golf club; and detecting, based on the magnetic field data and the acceleration data, that a contact of the smart golf club with a golf ball has occurred.

Certain embodiments provide a system for automatic scoring of a golf game. The system includes one or more golf tracks, each golf track associated with one or more holes and one or more smart golf clubs. Each smart golf club includes a shaft; a club head coupled to an end of the shaft; a magnetometer configured to collect magnetic field data associated with the smart golf club; an accelerometer configured to collect acceleration data associated with the smart golf club; a microcontroller configured to detect, based on the magnetic field data and the acceleration data, that a contact of the smart golf club with a golf ball has occurred; a power supply configured to supply power to one or more of: the magnetometer, the accelerometer, and the microcontroller; and a transmitter configured to transmit a signal indicating the detection of the contact of the smart golf club with the golf ball has occurred. The system includes a base station configured to receive the signal from the smart golf club; and compute a score of the golf game based, at least in part, on the signal.

To the accomplishment of the foregoing and related ends, the one or more aspects comprise the features hereinafter fully described and particularly pointed out in the claims. The following description and the appended drawings set forth in detail certain illustrative features of the one or more aspects. These features are indicative, however, of but a few of the various ways in which the principles of various aspects may be employed.

DESCRIPTION OF THE DRAWINGS

So that the manner in which the above-recited features of the present disclosure can be understood in detail, a more particular description, briefly summarized above, may be had by reference to aspects, some of which are illustrated in the drawings. It is to be noted, however, that the appended drawings illustrate only certain typical aspects of this disclosure and are therefore not to be considered limiting of its scope, for the description may admit to other equally effective aspects.

To facilitate understanding, identical reference numerals have been used, where possible, to designate identical elements that are common to the figures. It is contemplated that elements disclosed in one aspect may be beneficially utilized on other aspects without specific recitation.

DETAILED DESCRIPTION

The following description provides examples of a smart putter using a combination of sensors to perform stroke detection and a system for providing automatic scoring in putter games using the smart putter, and is not limiting of the scope, applicability, or examples set forth in the claims.

Changes may be made in the function and arrangement of elements discussed without departing from the scope of the disclosure. Various examples may omit, substitute, or add various procedures or components as appropriate. For instance, the methods described may be performed in an order different from that described, and various steps may be added, omitted, or combined. Also, features described with respect to some examples may be combined in some other examples. For example, an apparatus may be implemented or a method may be practiced using any number of the aspects set forth herein. In addition, the scope of the disclosure is intended to cover such an apparatus or method that is practiced using other structure, functionality, or structure and functionality in addition to, or other than, the various aspects of the disclosure set forth herein. It should be understood that any aspect of the disclosure disclosed herein may be embodied by one or more elements of a claim.

Figure 1:
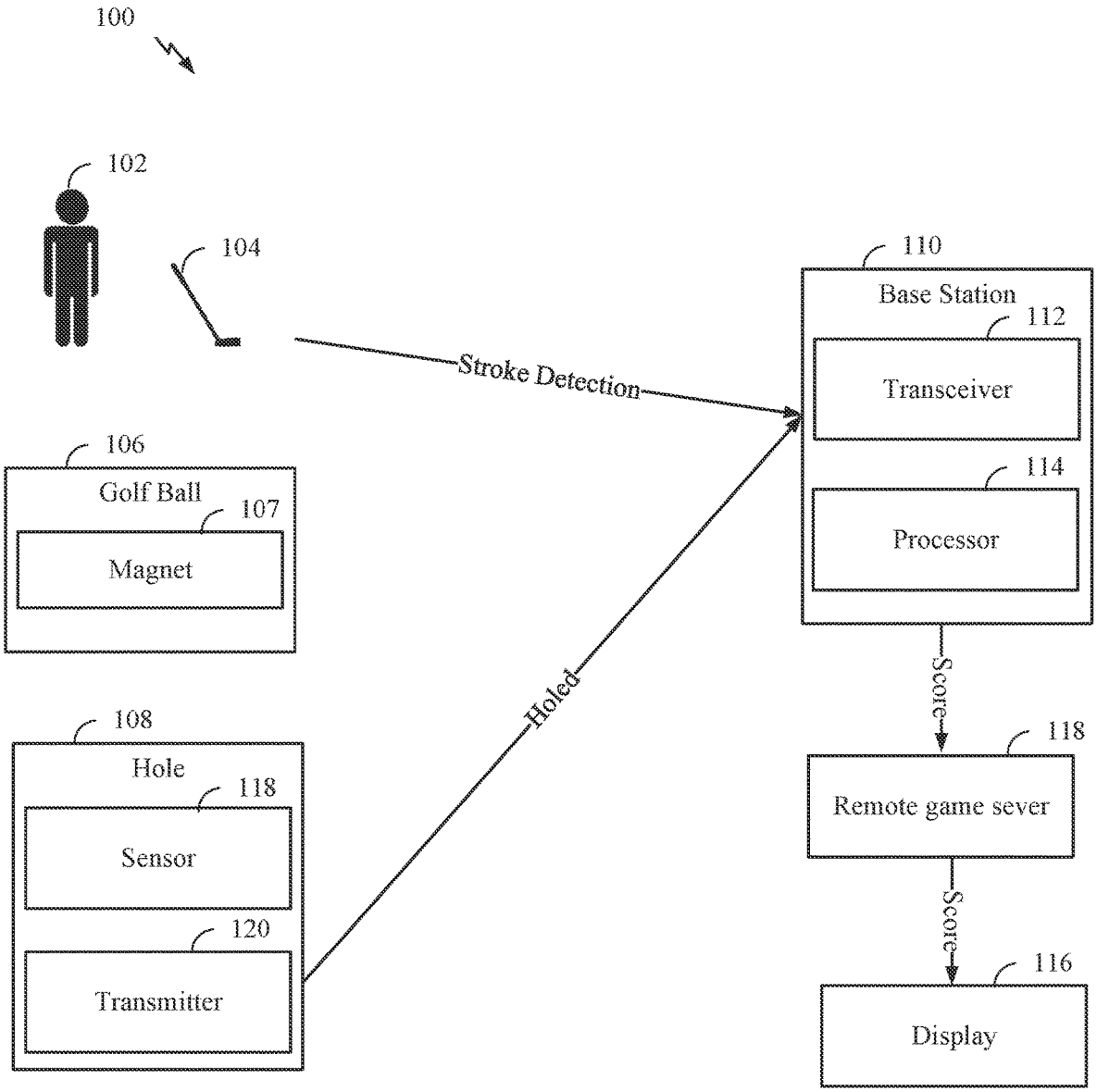
FIG. 1 depicts a block diagram conceptually illustrating an example of a putter game system with automatic scoring, in accordance with certain aspects of the present disclosure.

FIG. 1 depicts a block diagram conceptually illustrating an example of a putter game system 100. The putter game system 100 is played by a user 102 (e.g., also referred to as the player). The putter game system includes a smart putter 104, a golf ball 106, a base station 110, and a display 116. In some embodiments, the putter game is a miniature golf game.

User 102 plays the putter game using smart putter 104. In some embodiments, user 102 first signs-in as a player of the putter game. For example, user 102 may sign-in at a kiosk or using a user device (e.g., such as a smart phone, tablet, laptop, desktop computer, or other user device), via an application or website. In some embodiments, user 102 further registers with smart putter 104. In some examples, when the user 102 signs-in as a player of the putter game, a particular smart putter 104 is issued to the user 102. The smart putter 104 may then be registered to the user 102 to associate the user 102 with stroke detections by the associated smart putter 104 for purposes of score keeping for that user 102. In some embodiments, after the player signs-in and is issued a smart putter 104, the player then signs-in with the smart putter 104 at a particular track in order to begin play. As discussed in more detail below, smart putter 104 may include a radio frequency identifier (RFID) chip and/or a Bluetooth transmitter configured to sign-in the smart putter 104 with an RFID reader and/or Bluetooth receiver at the track to sign-in the player and the associated smart putter 104 at the track, to begin scoring for that track. In some embodiments, after signing-in the player and smart putter 104 at the track, an indicator at the track or located on smart putter 104 illuminates to indicate to the player that the putter game is ready to be played.

To play the putter game, user 102 strikes a golf ball 106 with smart putter 104, with the objective of landing golf ball 106 in hole 108 (e.g., referred to as "holed") located on a "track", where the track may include a green (e.g., a predefined area of play) including hole 108 in the green. Although one hole 108 is shown, putter game system 100 may include a plurality of different holes 108 associated with one track or a plurality of tracks.

As discussed in more detail below with respect to FIGS. 2-5, smart putter 104 may be configured with multiple sensors in order to detect a stroke has occurred. A stroke may be defined as when a user 102 makes an intentional swing with smart putter 104 and strikes golf ball 106. Unintentional swings of smart putter 104 and/or strikes of objects other than a golf ball 106 may be registered by smart putter 104 and/or putter game system 100, but are not counted as strokes (e.g., which would otherwise be a misdetections as such swings and/or strikes of objects other than a golf ball are not intended to be counted against the player's score).

In some embodiments, golf ball 106 includes a magnet 107. As discussed in more detail below with respect to FIGS. 2-5, magnet 107 may interact with a magnetic sensor (e.g., a magnetometer) of smart putter 104 in order for smart putter 104 to detect when smart putter 104 is within a threshold proximity of golf ball 106 based on changes to a magnetic field between smart putter 104 and magnet 107, where such detected changes to the magnetic field are used in determining whether to register that a stroke has occurred.

As shown in FIG. 1, smart putter 104 is further configured to transmit a signal to base station 110. For example, smart putter 104 may transmit a signal to base station 110 indicating a stroke detection has occurred. Base station 110, or an associated processor or server, may tally player's strokes and use the tally for automatic scoring of the putter game.

As noted above, the putter game system 100 may include a plurality of holes 108. For example, the putter game system 100 may comprise nine or eighteen tracks, each track associated with a hole. Other numbers of holes and tracks are also contemplated herewith. In some embodiments, each hole 108 includes a sensor 118 and a transmitter 120. Sensor 118 may be configured to detect when golf ball 106 is "holed" (e.g., when user 102 hits golf ball 106 into hole 108). In some embodiments, sensor 118 may comprise a magnetometer. The magnetometer is operable to detect the presence of a magnetic golf ball 106 in the hole 108. Upon detecting the presence of golf ball 106 in hole 108, transmitter 120 may transmit a signal to base station 110 to indicate the player's completion of that track.

Putter game system 100 is operable to automatically count the user's 102 strokes in order to automatically tally the score of the putter game. As shown in FIG. 1, base station 110 includes a transceiver 112 and a processor 114. In some embodiments, base station 110 may be located at a kiosk associated with putter game system 100. Transceiver 112 may receive the stroke detection signals from smart putter 104. Each time transceiver 112 receives a stroke detection signal from smart putter 104, processor 114 increments the player's stroke count. In addition, transceiver 112 may receive a signal from transmitter 120 at hole 108 indicating user 102's completion of the track. In some embodiments, the base station 110 detects the completion of the track. For example, the base station 110 may have a wired connection to a magnetic sensor 118 inside hole 108. When the magnetic golf ball 106 enters the hole 108, the base station 110 detects a signal via the connection with the magnetic sensors 118 in the hole 108.

At completion of the track, processor 114 may compare the player's number of strokes taken to complete the track associated with hole 108 to a par value associated with hole 108 in order to compute the player's score for that track. It should be noted that such scoring is only one example of a scoring system and that the stroke detection by smart putter 104 may be used in other scoring methods. Further, while transceiver 112 and processor 114 are shown in base station 110 in FIG. 1, it should be understood that in some embodiments transceiver 112 and processor 114 may be implemented as components of separate devices. In some embodiments, the base station 110 sends the player's score to a remote game server 118 that tracks the scores for multiple players.

As shown in FIG. 1, base station 110 (and/or the remote game server 118) may provide the computed player's score to display 116 (or to multiple different displays). Display 116 may display additional information, such as the number of strokes, the par value, a per-track score, the player's cumulative score over a plurality of tracks, the player's name, and the like. In addition, the remote game server 118 (and/or the base station 110) may receive and display information for multiple players (e.g., on a leaderboard). In some embodiments, putter game system 100 includes a plurality of displays 116. In some embodiments, display 116 may be co-located at a kiosk with base station 110, may be located at each track associated with each hole 108, and/or at other locations associated with putter game system 100. In some embodiments, display 116 is a user device associated with user 102, such as the device used to sign-in the player with putter game system 100.

Figure 2:
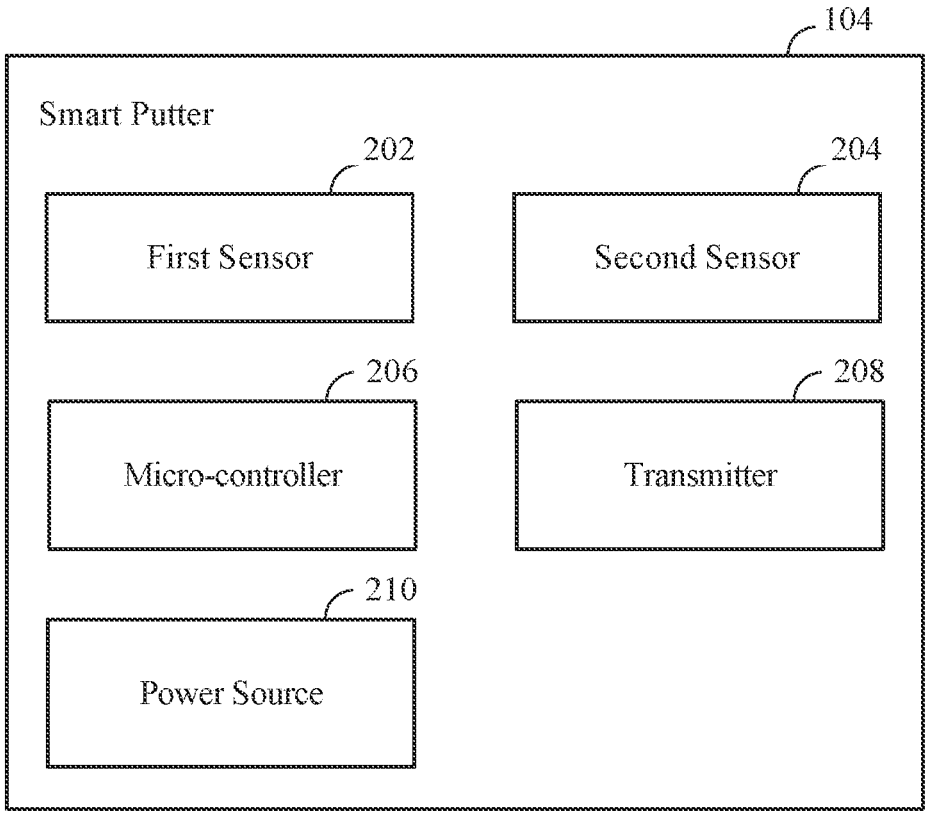
FIG. 2 depicts a block diagram conceptually illustrating an example of a smart putter for use in the putter game system, in accordance with certain aspects of the present disclosure.

FIG. 2 depicts a block diagram conceptually illustrating an example of a smart putter 104 for use in the putter game system 100 of FIG. 1. As discussed above, smart putter 104 may be configured to detect player's strokes. In some embodiments, smart putter 104 includes a plurality of sensors for stroke detection, in order to minimize misdetections. As shown in FIG. 2, smart putter 104 includes at least a first sensor 202 and a second sensor 204, a microcontroller 206, a transmitter 208, and a power source 210.

In some embodiments, first sensor 202 is one or more accelerometers. First sensor 202 may be configured to collect data including speed, angle, and acceleration of smart putter 104. Data from first sensor 202 may be used to determine an "impact" with an object (e.g., golf ball 106) or a "swing" by smart putter 104 has occurred. For example, first sensor 202 may provide the acceleration data to microcontroller 206. Microcontroller 206 may process the acceleration data to determine whether an acceleration profile is satisfied to determine whether a swing of smart putter 104 has occurred and/or whether contact with an object has occurred. In some embodiments, the accelerometer data may be sampled at a sample rate, such as 500 Hz. The data can be differentiated to obtain a difference between the data points. The acceleration profile may be defined to distinguish a true swing from other movements of smart putter 104, such movements of smart putter 104 due to walking, practice swings, and other player's movements while holding smart putter 104. The acceleration profile may indicate contact with an object (e.g., when the acceleration profile indicates acceleration and momentary deceleration of smart putter 104). The acceleration profile may define one or more thresholds associated with the speed, angle, and acceleration data.

In some embodiments, the differentiated acceleration data (e.g., an acceleration value and/or a change in acceleration value) can be compared to a first threshold and a second threshold that is higher than the first threshold. The first and second thresholds may be minimum or maximum acceleration value thresholds, change in acceleration value thresholds, or a threshold value point that the acceleration data crosses. The first threshold may be associated with a "soft" hit and the second threshold may be associated with a "strong" hit. When the differentiated acceleration data exceeds the "strong" hit threshold, a stroke condition is satisfied. When the differentiated acceleration data exceeds the "soft" hit threshold, but does not exceed the "strong" hit threshold, then a second check is performed to determine the duration of time that the data exceeded the "soft" hit threshold. For example, when the duration that the acceleration data exceeded the "soft" hit threshold is at or above a time duration threshold, then the stroke condition is not considered satisfied. When the duration that the acceleration data exceeded the "soft" hit threshold is below the time duration threshold, then the stroke condition may be considered satisfied.

Second sensor 204 is configured to detect that the impacted object was a golf ball 106. In some embodiments, second sensor 204 is a magnetometer that measures the strength of a magnetic field. In this embodiment, golf ball 106 is magnetic (e.g., as shown in FIG. 1, golf ball 106 may have an embedded magnet 107). When smart putter 104 moves closer to magnetic golf ball 106, the magnetic field between smart putter 104 and magnetic golf ball 106 will become stronger and will become weaker when smart putter 104 moves further from magnetic golf ball 106. Second sensor 204 will detect the changes in the magnetic field, which can be used in addition to the data from first sensor 202 to detect a stroke. In some embodiments, second sensor 204 may send a signal to microcontroller 206 when a strength of the magnetic field (e.g., amperes per meter (A/m)), or change in the strength of the magnetic, crosses or exceeds a threshold. For example, second sensor 204 may detect that a stroke condition is satisfied and send the signal to the microcontroller 206 when the strength of the magnetic field is at or above around 120 μT (microteslas). In some embodiments, second sensor 204 may send data to microcontroller 206 and based on a profile of changes to the magnetic field, microcontroller 206 may determine that a stroke occurred (e.g., when the data shows the magnetic field quickly becomes strong and then weak).

In some embodiments, microcontroller 206 filters out portions of the accelerometer data from second sensor 204 to generate a simple signal indicating smart putter 104 has impacted an object or that a swing has occurred. In some embodiments, the accelerometer can be filtered to remove portions of the data that fall within one or more ranges or thresholds. In one example, the filtering may including filtering out acceleration data indicating changes in velocity that are at or below a specified threshold (e.g., $a \leq x$ m/s), while acceleration data indicating changes in velocity above the specified threshold (e.g., $a > x$ m/s) are maintained and analyzed (e.g., including the acceleration profile). Analyzing the maintained acceleration data may include determining whether the rate and slope of the change in velocity is characteristic of the club coming into contact with an object having the size and weight of a golf ball (e.g., by comparing the acceleration profile of the measured and filtered acceleration profile to a specified acceleration profile indicating the contact with the golf ball, which may be defined by one or more ranges and/or thresholds of values). If the analyzed rate and slope of the change in velocity meets the specified characteristics, microcontroller 206 registers a "hit" or "true" from the accelerometer.

With a combination of sensors, a stroke may only be detected when both first sensor 202 and second sensor 204 are "true" (i.e., when a stroke condition is satisfied at both the first sensor 202 and second sensor 204). In other words, a stroke is detected only when first sensor 202 satisfies the pre-determined acceleration profile and second sensor 204 satisfies the pre-determined magnetic field profile. In some embodiments, a stroke is only detected when first sensor 202 and second sensor 204 are true within a defined time frame. That is, for a stroke to be detected, first sensor 202 and second sensor 204 may need to be true at the same time or near to the same time.

In some embodiments, smart putter 104 is further configured to detect a "nudge." As used herein, a nudge may be defined as a continuous (or near continuous) contact by smart putter 104 with golf ball 106 while the golf ball 106 is in motion, such as where the player may be using smart putter 104 to roll the golf ball 106 (e.g., "cheating"). The putter game system (e.g., microcontroller 206) may be configured to detect a "nudge" and trigger an error indication to the user.

In some embodiments, the magnetic sensor data may processed to detect continuous fluctuations in the magnetic field strength profile consistent with the golf ball 106 being rolled while in contact with the putter (e.g., based on a comparison to a specified magnetic field strength profile, which may be defined based on or more thresholds). In some embodiments, the accelerometer data may be processed to detect continuous fluctuations in the acceleration profile consistent with the golf ball 106 being rolled while in contact with the putter (e.g., based on a comparison to a specified acceleration profile, which may be defined based on or more thresholds). In some embodiments, data from a different sensor may be processed to detect a nudge. For example, the magnetometer samples the magnetic field at a sampling rate. The magnetic field data includes magnetic field strength components in the x-axis, y-axis, and z-axis. The microcontroller 206 may be configured to detect a nudge of the golf ball 106 when a value of the magnetic field strength in any of the x-axis, y-axis, or z-axis, or a change in the value of the magnetic field strength, crosses or is at or above a threshold value for at least a minimum time duration threshold.

In some embodiments, microcontroller 206 detects the nudge and sends a signal to the base station 110, which triggers the error indication to be displayed to the user. In some embodiments, the error indication may be an indicator light (e.g., at smart putter 104, at the track, on a display, or on a user device), an audio indicator (e.g., a buzz, a verbal warning, or other audio alert), or a displayed text. In some embodiments, the base station 110 or kiosk may take another action based on the signal from microcontroller 206. For example, base station 110 may adjust the player's score or deactivate smart putter 104.

This combination of sensors for stroke detection may reduce misdetection because a player may "swing" smart putter 104, without actually being near to or impacting golf ball 106. Similarly, smart putter 104 may be very near golf ball 106, without the player actually swinging at or striking golf ball 106. With the combination of first sensor 202 and second sensor 204, however, microcontroller 206 can determine both that the player took a "swing" and/or that an "impact" occurred with smart putter 104 and also that the swing or impact occurred very near to golf ball 106. As such, there is a high likelihood that the player performed a stroke and the likelihood of misdetection is low.

Figure 4:
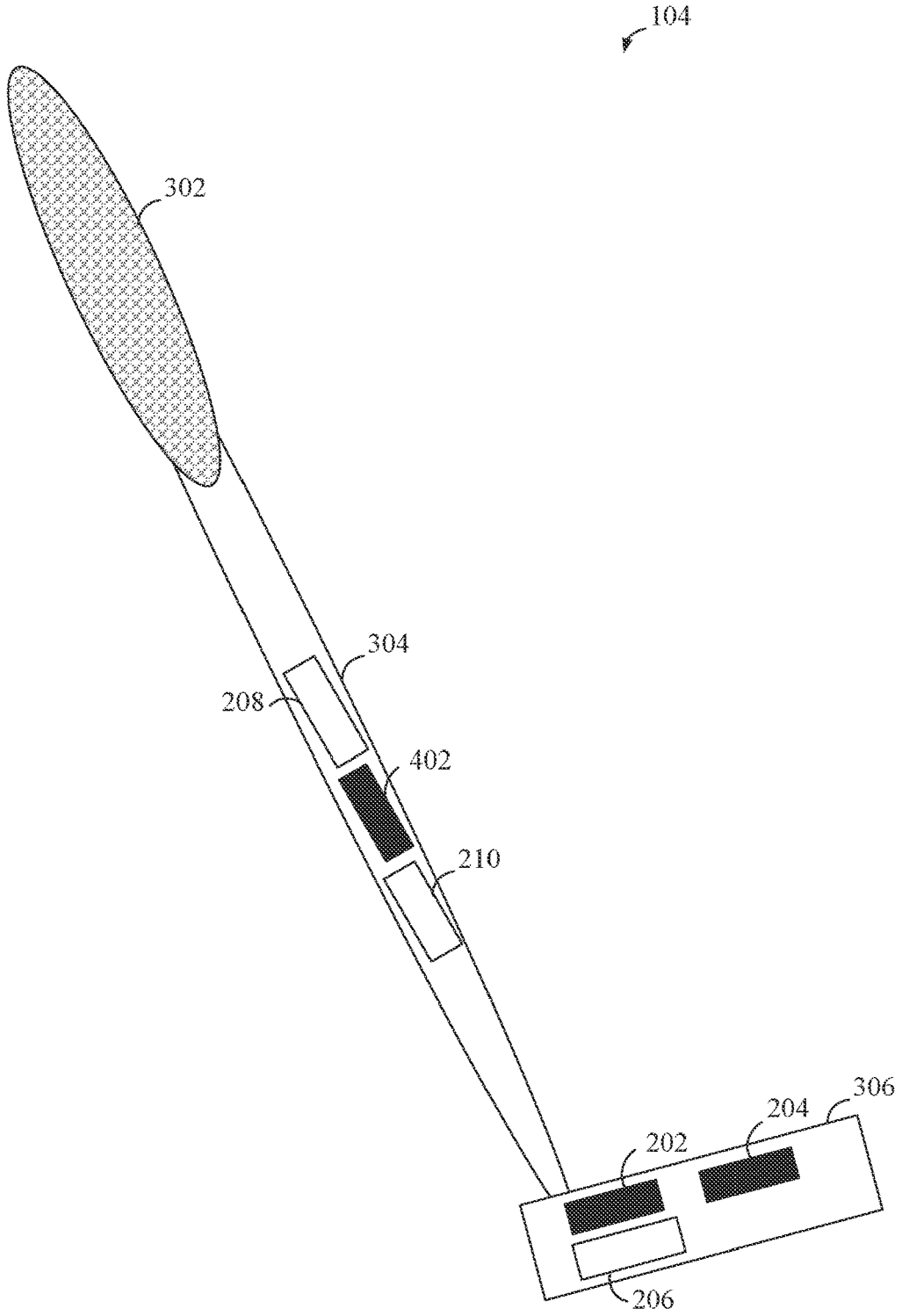
FIG. 4 depicts another example of a smart putter, in accordance with certain aspects of the present disclosure.

In some embodiments, different combinations of sensors may be used for stroke detection. Further, in some embodiments, combinations of more than two sensors may be used (as shown in FIG. 4 discussed in more detail below). The use of additional sensor may further reduce the possibility of misdetection of strokes. For example, in some embodiments, an impact sensor, an audio sensor, an RFID reader/tag, and/or another type of sensor may be used alternatively or in addition to the accelerometer and/or magnetometer.

An impact sensor may be used to indicate that smart putter 104 has impacted an object (e.g., golf ball 106). An example of an impact sensor is a piezoelectric sensor. The piezoelectric sensor may be made of a piezoelectric material (e.g., quartz crystal, polycrystalline ceramic, or the like) that senses change in force due to mechanical stress. The piezoelectric material generates an electric charge, which can be measured as a voltage, when force is applied to the piezoelectric. Other impact sensors includes piezoresistive sensors, strain gage sensors, transducers, capacitive transducers, shock sensors. Thus, alternatively or in addition to swing and proximity detection provided by acceleration and magnetic field sensors, impact sensors can further reduce misdetection by providing an indication that an impact has occurred based on sensing the change in force.

An audio sensor may be utilized to detect object impact. The audio sensor may collect acoustic, sound, and/or vibration data. Some examples of audio sensors include geophones, microphones, pickups, seismometers, and the like. An audio sensor may collect audio data that may be compared to a sound profile corresponding to the sound of a golf ball being struck by the smart putter 104. Thus, alternatively or in addition to the sensors described above, audio sensors can further reduce misdetection by providing an indication that an impact has occurred based on sensing an audio profile.

An RFID reader on smart putter 104 may be used to scan an ultrahigh frequency (UHF) tag inside of golf ball 106. Similar to the use of the magnetometer, use of an RFID reader and tag can, additionally or alternatively, be used to provide an indication that smart putter 104 is within a near proximity of golf ball 106 to improve stroke detection and reduce misdetections.

As discussed above, microcontroller 206 is configured to interpret data from a plurality of sensors, including first sensor 202 and second sensor 204 to determine a stroke has occurred. Microcontroller 206 causes a signal to be transmitted to base station 110, via transmitter 208, indicating the stroke has occurred. In some embodiments, microcontroller 206 is further configured to count (e.g., tally) the strokes and transmitter 208 sends a current stroke count to the base station 110, so the base station 110 can compute the player's score and cause the score to be displayed. In some embodiments, microcontroller 206 is further configured to compute the player's score and transmitter 208 sends the player's score to the base station 110 so the base station 110 can cause the player's score to be displayed. In some embodiments, transmitter 208 may send the current stroke count and/or the player's score directly to a display.

Smart putter 104 further includes circuitry for wireless data communication. In some embodiments, transmitter 208 is configured for a short-range communication (e.g., such as Bluetooth or Wi-Fi) and/or longer-range communication (e.g., such as LTE, 4G, 5G, or other type of wireless communication). In some embodiments, transmitter 208 is configured for Bluetooth as well as connected to a local area network (LAN) that uses a micro transport protocol (uTP). Transmitter 208 may be configured to transmit a signal to base station 110 indicating detection of a stroke. In some embodiments, smart putter 104 further includes an RFID chip.

Smart putter 104 further include a power source 210. Power source 210 is configured to supply power to any of the electronics in smart putter 104. For example, power source 210 may supply power to first sensor 202, second sensor 204, microcontroller 206, and transmitter 208. Power source 210 may be a solar panel or a battery. In some embodiments, power source 210 is a lithium ion battery. In some embodiments, smart putter 104 further includes circuitry for charging the battery.

In some embodiments, a kiosk is located at each track (e.g., located at the tee associated with that track) of putter game system 100. In some embodiments, the player signs in at each track. In some embodiments, smart putter 104 performs the sign-in. During a play session, a unique putter ID (e.g., a Bluetooth device ID or RFID tag) may be used to distinguish between various players, each of which has been issued their own smart putter. A player will use the same smart putter 104 throughout the entire course (e.g., the plurality of tracks associated with the plurality of holes 108). The unique putter ID allows the putter game system 100 to distinguish one player from another and allows the system to know which player is active at any given track. Once signed in, a profile for the player is activated, a stroke or score counter associated with the smart putter 104 is reset, and the game begins.

In some embodiments, smart putter 104 includes a Bluetooth low energy (BLE) device (which may be transmitter 308 or a separate component of smart putter 104). The BLE device may be used to sign-in at a particular track to putter game system 100. For example, the user 102 may hold smart putter 104 close to a BLE beacon (e.g., located at the kiosk). In some embodiments, a probe message (e.g., a BLE beacon) may be continuously or periodically broadcast (e.g., over Bluetooth) by the kiosk. Smart putter 104 may detect the probe signals and, when the signal strength of the probe signal meet a threshold signal strength, the smart putter 104 may automatically attempt registration by transmitting a registration request including its Bluetooth device ID. In some embodiments, smart putter 104 transmits BLE probe/beacon signals and the base station 110 scans for the BLE probe/beacon signals.

In some embodiments, smart putter 104 includes an RFID chip. The base station 110 includes an RFID reader embedded somewhere on the court (e.g., located at the tee) that will read the RFID tag of smart putter 104 to "sign-in" smart putter 104 with the track (e.g., when the player holds smart putter 104 near to the RFID reader).

Although not shown, smart putter 104 further includes circuitry connecting the electronics in smart putter 104, such as circuitry connecting power source 210, transmitter 208, microcontroller 206, first sensor 202, and second sensor 204.

Figure 3:
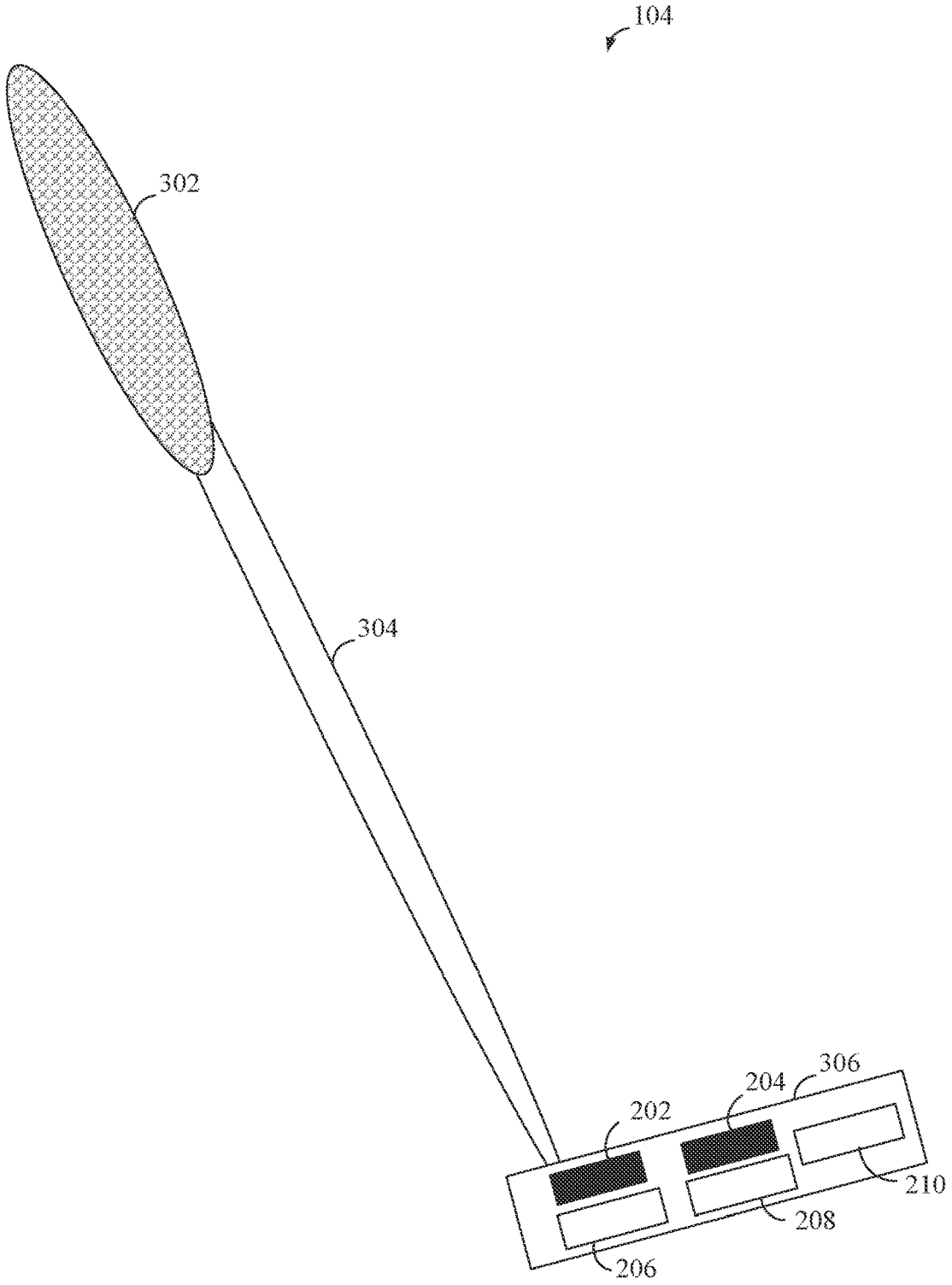
FIG. 3 depicts an example of a smart putter, in accordance with certain aspects of the present disclosure.

FIG. 3 depicts an example of smart putter 104, in accordance with certain aspects of the present disclosure. As shown in FIG. 3, smart putter 104 may include a putter head 306, a shaft 304, and a grip 302. Putter head 306 couples to a bottom end of shaft 304. Grip 302 couples to an upper portion of shaft 304. Putter head 306 and shaft 304 may be made of any suitable material, such as plastic, steel, bronze, wood, aluminum, brass, copper, zinc, titanium, or graphite. In some embodiments, the shaft 304 is preferably wood or aluminum when the smart putter 104 includes a magnetometer sensor, in order to avoid unwanted magnetization. In some embodiments, putter head 306 is a blade putter head, a mallet putter head, or a semi-mallet putter head. Grip 302 may be any suitable material to be comfortably held by a human hand. In some embodiments, grip 302 is made of leather, synthetic leather, rubber, plastic, or a combination thereof.

Although shown at putter head 306, first sensor 202, second sensor 204, microcontroller 206, transmitter 208, and power source 210 may be located anywhere on, or embedded within, smart putter 104, including grip 302, shaft 304, or putter head 306. In some embodiments, second sensor 204 may preferably be located at putter head 306. FIG. 4 depicts an illustrative example of smart putter 104 with first sensor 202, second sensor 204, and microcontroller 206 located at putter head 306, but with transmitter 208 and power source 210 located at shaft 304, and including an additional sensor 402 located at shaft 304. While FIG. 3 and FIG. 4 illustrate two example configurations of smart putter 104, it should be understand that the components of smart putter 104 may be configured at different locations and that smart putter 104 may include additional sensor and/or other components that are not shown.

Figure 5:
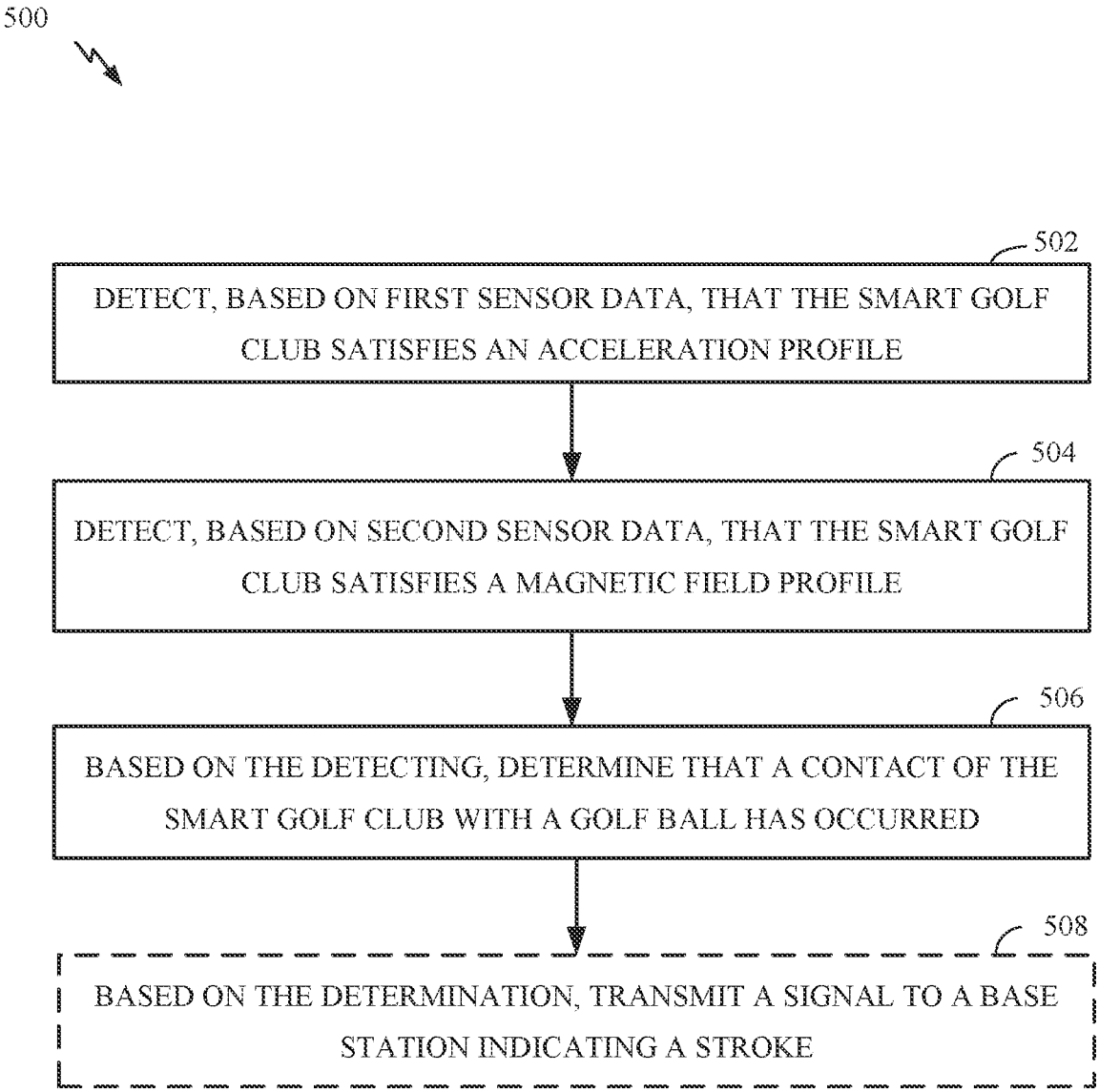
FIG. 5 is a flow diagram illustrating example operations for stroke detection by a smart putter, in accordance with certain aspects of the present disclosure.

FIG. 5 is a flow diagram of example operations 500 for stroke detection by a smart golf club (e.g., such as smart putter 104), in accordance with certain aspects of the present disclosure.

Operations 500 begin at operation 502, with detecting, based on first sensor data, that the smart golf club satisfies an acceleration profile. For example, operation 502 may include microcontroller 206 receiving a signal from first sensor 202. The signal from first sensor 202 may be triggered based on a detected acceleration satisfying a threshold. The signal from first sensor 202 may include raw or filtered acceleration data. Microcontroller 206 may compare the acceleration data to an acceleration profile to detect that the putter satisfies the acceleration profile. In some embodiments, the acceleration profile determines whether the acceleration, or a change in acceleration, exceeds a threshold, falls below a threshold, or crosses a threshold. The acceleration profile may satisfy a stroke detection condition indicating that a "swing" and/or an "impact" has occurred.

At operation 504, the smart golf club (e.g., smart putter 104) detects, based on second sensor data, that the smart golf club satisfies a magnetic field profile. For example, microcontroller 206 may receive a signal from second sensor 204. The signal from second sensor 204 may be triggered based on a detected magnetic field strength, or change to a magnetic field strength, satisfying a threshold. The signal from second sensor 204 may include raw or filter magnetic field strength data. Microcontroller 206 may compare the magnetic field strength data to magnetic field profile to detect that the smart putter satisfies the magnetic field strength profile. In some embodiments, the magnetic field strength profile determines whether the magnetic field strength, or a change in magnetic field strength, exceeds a threshold, falls below a threshold, or crosses a threshold. The magnetic field strength profile may satisfy a stroke detection condition indicating that the putter is within a threshold proximity of a magnetic golf ball (e.g., based on a value of the magnetic field strength) or that a "swing" has occurred (e.g., based on changes to the magnetic field strength).

In some embodiments, the acceleration data is not checked (e.g., collected and/or processed) until the magnetic field strength data satisfies a stroke detection condition. For example, the step 502 may not be performed until the step 504 is completed. In some embodiments, when the magnetic field strength, or change to magnetic field strength, satisfies the threshold, at 504, and the microcontroller 206 detects the smart putter satisfies the magnetic field strength profile, then the acceleration data is collected. When the magnetic field data falls below the threshold, then the acceleration data is checked to determine to detect, at 502, to detect whether the acceleration meets the acceleration threshold/profile for satisfying a stroke detection condition.

At operation 506, the smart golf club (e.g., smart putter 104) determines that a contact of the smart golf club with a golf ball has occurred based on the detecting. For example, the smart putter 104 may determine that a contact of the smart putter 104 with a golf ball 106 has occurred (e.g., detects a stroke) when both a first stroke detection condition associated with the magnetic field strength data and a second stroke detection condition associated with the acceleration data are satisfied.

At operation 508, the smart golf club (e.g., smart putter 104) transmits a signal to a base station indicating a stroke detection based on the determination at 506. For example, based on detecting the signal from first sensor 202 indicating the acceleration profile is satisfied and the signal second sensor 204 indicating the magnetic field strength profile is satisfied, transmitter 208 transmits a signal to base station 110 indicated a detected stroke.

Figure 6:
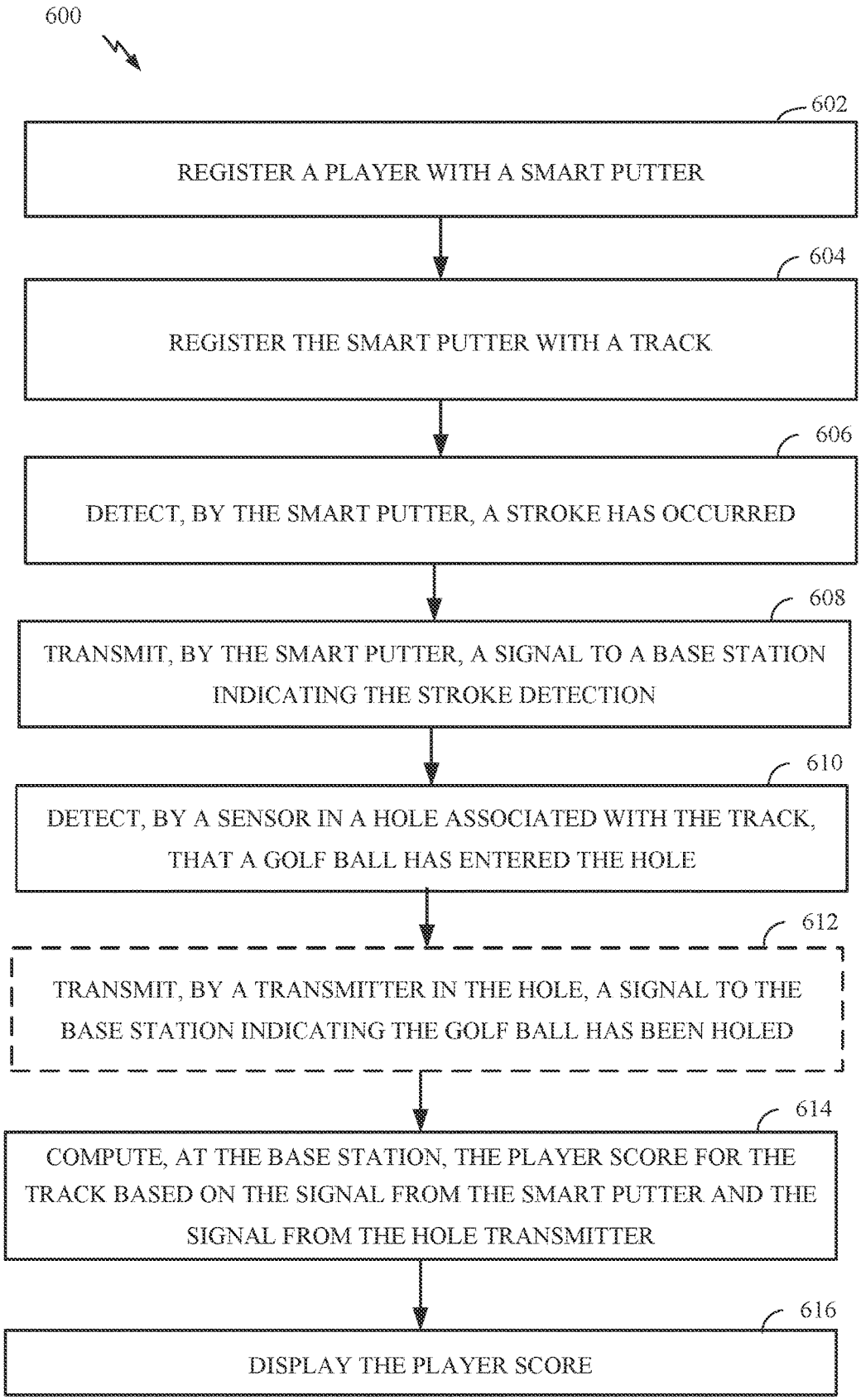
FIG. 6 is a flow diagram illustrating example operations for a putter game with automatic scoring including stroke detection by a smart putter, in accordance with certain aspects of the present disclosure.

FIG. 6 is a flow diagram illustrating example operations 600 for a putter game with automatic scoring including stroke detection by a smart putter, in accordance with certain aspects of the present disclosure.

Operations 600 may begin, at operation 602, by registering a player (e.g., user 102) with a smart putter (e.g., smart putter 104). This may allow stroke detection from smart putter 104 to be associated with user 102. In some embodiments, the smart putter and player may further be registered with a golf ball (e.g., golf ball 106). This may allow putter game system 100 to determine when user 102 has completed a track associated with a hole 108. At operation 604, the smart putter is signed-in at a track. This may allow putter game system 100 to determine the player's score for a track when the track is completed.

At operation 606, the smart putter may detect a stroke has occurred (e.g., by performing the operations 500). At operation 608, the smart putter transmits a signal to a base station (e.g., at a kiosk or located at the track, i.e., a track-controller) indicating the detection of a stroke.

At operation 610, a sensor in the hole detects that a golf ball has entered the hole. At operation 612, a transmitter in the hole transmits a signal to base station indicating the golf ball has been holed. Alternatively, the base station detects the that the golf ball has entered the hole via a wired connection between the base station and the sensor in the hole.

At operation 614, the player's score for the track is computed at the base station (e.g., or at a kiosk) based on the signal from the smart putter indicating stroke detection and the signal from the hole transmitter indicating the player's completion of the track. The player's cumulative score for a plurality of tracks may also be computed at the base station (or at the remote game server 118).

At operation 616, the player's score is displayed. The score may be displayed on a display at the kiosk, at the hole, on the player's user device, and/or on another display.

The methods disclosed herein comprise one or more steps or actions for achieving the methods. The method steps and/or actions may be interchanged with one another without departing from the scope of the claims. In other words, unless a specific order of steps or actions is specified, the order and/or use of specific steps and/or actions may be modified without departing from the scope of the claims.

As used herein, the term "determining" encompasses a wide variety of actions. For example, "determining" may include calculating, computing, processing, deriving, investigating, looking up (e.g., looking up in a table, a database or another data structure), ascertaining and the like. In addition, "determining" may include receiving (e.g., receiving information), accessing (e.g., accessing data in a memory) and the like. Also, "determining" may include resolving, selecting, choosing, establishing, and the like.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112(f) unless the element is expressly recited using the phrase "means for" or, in the case of a method claim, the element is recited using the phrase "step for."

It is to be understood that the claims are not limited to the precise configuration and components illustrated above. Various modifications, changes, and variations may be made in the arrangement, operation, and details of the methods and apparatus described above without departing from the scope of the claims.

What is claimed is:

1. A smart golf club, comprising:

a shaft;

a club head coupled to an end of the shaft;

a magnetometer configured to collect magnetic field data associated with the smart golf club;

an accelerometer configured to collect acceleration data associated with the smart golf club, wherein the acceleration data includes velocity data;

a microcontroller configured to detect, based on the magnetic field data and the acceleration data, that a contact of the smart golf club with a golf ball has occurred, wherein the microcontroller is configured to:

sample the velocity data at a sampling rate;

differentiate the velocity data to determine one or more acceleration measurements; and compare the one or more acceleration measurements to a first threshold and a second threshold, the second threshold being higher than the first threshold; and detect the contact of the smart golf club with the golf ball has occurred based at least in part on the comparison; and a power supply configured to supply power to one or more of: the magnetometer, the accelerometer, and the microcontroller.

2. The smart golf club of claim 1, further comprising a transmitter configured to send a wireless signal indicating, to a receiving device, the detection of the contact of the smart golf club with the golf ball.

3. The smart golf club of claim 2, wherein the transmitter comprises a Bluetooth transmitter, a wireless local area network (WLAN) transmitter, or a wireless wide area network (WWAN) transmitter.

4. The smart golf club of claim 1, wherein the magnetometer, the accelerometer, the microcontroller, and the power supply are coupled to or in embedded in the shaft, the club head, or a grip coupled to an opposite end of the shaft of the smart golf club as the club head.

5. The smart golf club of claim 1, wherein the microcontroller is configured to compare the magnetic field data to a magnetic field profile to determine the magnetic field data satisfies a first detection condition.

6. The smart golf club of claim 5, wherein the magnetic field profile comprises at least one of:

one or more magnetic field strength thresholds;

one or more change in magnetic field strength thresholds; or one or more time thresholds.

7. The smart golf club of claim 5, wherein the magnetic field data includes magnetic field strength data, and wherein the microcontroller is configured to determine the magnetic field data satisfies the first detection condition when:

the magnetic field strength increases to a first magnetic field strength threshold at a first time; and the magnetic field strength decreases to a second magnetic field strength threshold at a second time within a time threshold of the first time.

8. The smart golf club of claim 1, wherein the microcontroller is configured to:

determine the acceleration data satisfies a second detection when the one or more acceleration measurements is at or above the second threshold; and determine the acceleration data satisfies the second detection condition when the one or more acceleration measurements is at or above the first threshold and below the second threshold within a threshold time duration.

9. The smart golf club of claim 8, wherein the microcontroller is configured to determine the contact of the smart golf club with the golf ball has occurred when:

the one or more acceleration measurements increases to a first acceleration threshold at a first time; and the one or more acceleration measurements decreases to a second acceleration threshold at a second time within a time duration threshold of the first time.

10. The smart golf club of claim 1, wherein the microcontroller is configured to detect the contact of the smart golf club with the golf ball has occurred only when both the magnetic field data satisfies a first detection condition and the acceleration data satisfies a second detection condition.

11. The smart golf club of claim 10, wherein the microcontroller is configured to detect the contact of the smart golf club with the golf ball has occurred when the magnetic field data satisfies the first detection condition at a first time and the acceleration data satisfies the second detection condition at a second time within a threshold time duration of the first time.

12. The smart golf club of claim 1, wherein the microcontroller is configured to:

sample the magnetic field data at a sampling rate, wherein the magnetic field data includes magnetic field strength in an x-axis, y-axis, and z-axis;

detect a nudge of the golf ball when an absolute value of the magnetic field strength in at least one of the x-axis, y-axis, or z-axis is at or above a threshold value for at least a minimum time duration threshold; and output an indication of the nudge detection, wherein the nudge detection indicates a continuous or repeated contact of the smart club with the golf ball while the golf ball is in motion.

13. The smart golf club of claim 1, wherein:

the smart golf club further comprises an audio sensor configured to collect audio data associated with the smart golf club; and the microcontroller is configured to detect the contact of the smart golf club with the golf ball has occurred further based on the audio data.

14. The smart golf club of claim 1, wherein:

the smart golf club further comprises an impact sensor configured to collect impact data associated with the smart golf club; and the microcontroller is configured to detect the contact of the smart golf club with the golf ball has occurred further based on the impact data.

15. The smart golf club of claim 1, wherein:

the smart golf club further comprises a radio frequency identifier (RFID) reader configured to detect an RFID tag associated with the golf ball; and the microcontroller is configured to detect the contact of the smart golf club with the golf ball has occurred further based on the RFID tag detection.

16. The smart golf club of claim 1, wherein:

the smart golf club further comprises a radio frequency identifier (RFID) tag or a Bluetooth transmitter configured to sign-in the smart golf club to an RFID reader or Bluetooth receiver associated with a golf track associated with a golf game.

17. A method for stroke detection, the method comprising:

collecting magnetic field data associated with a smart golf club;

collecting acceleration data associated with the smart golf club, wherein the acceleration data includes velocity data; and detecting, based on the magnetic field data and the acceleration data, that a contact of the smart golf club with a golf ball has occurred, wherein the detecting includes comparing the acceleration data to an acceleration profile to determine the contact of the smart golf club with the golf ball has occurred, and wherein the comparing includes:

sampling the velocity data at a sampling rate;

differentiating the velocity data to determine one or more acceleration measurements; and comparing the one or more acceleration measurements to a first threshold and a second threshold, higher than the first threshold.

18. A system for automatic scoring of a golf game, the system comprising:

one or more golf tracks, each golf track associated with one or more holes;

one or more smart golf clubs, each smart golf club comprising:

a shaft;

a club head coupled to an end of the shaft;

a magnetometer configured to collect magnetic field data associated with the smart golf club;

an accelerometer configured to collect acceleration data associated with the smart golf club, wherein the acceleration data includes velocity data;

a microcontroller configured to detect, based on the magnetic field data and the acceleration data, that a contact of the smart golf club with a golf ball has occurred, wherein the microcontroller is configured to:

sample the velocity data at a sampling rate;

differentiate the velocity data to determine one or more acceleration measurements; and compare the one or more acceleration measurements to a first threshold and a second threshold, the second threshold being higher than the first threshold;

and detect the contact of the smart golf club with the golf ball has occurred based at least in part on the comparison;

a power supply configured to supply power to one or more of: the magnetometer, the accelerometer, and the microcontroller; and a transmitter configured to transmit a signal indicating the detection of the contact of the smart golf club with the golf ball has occurred; and a base station configured to:

receive the signal from the smart golf club; and compute a score of the golf game based, at least in part, on the signal.

* * * * *